US007559373B2

(12) United States Patent
Jackson et al.

(10) Patent No.: US 7,559,373 B2
(45) Date of Patent: Jul. 14, 2009

(54) PROCESS FOR FRACTURING A SUBTERRANEAN FORMATION

(75) Inventors: Robert A. Jackson, Calgary (CA); Gary M. Poirier, Calgary (CA); Stephen Glanville, Okotoks (CA); Ashley C. Kalenchuk, Calgary (CA); Paul G. Goodman, Airdrie (CA); F. Merrill Jamieson, Calgary (CA)

(73) Assignees: Sanjel Corporation, Calgary (CA); Fairborne Energy Ltd, Calgary (CA)

( * ) Notice: Subject to any disclaimer, the term of this patent is extended or adjusted under 35 U.S.C. 154(b) by 283 days.

(21) Appl. No.: 11/421,030

(22) Filed: May 30, 2006

(65) Prior Publication Data

US 2007/0007003 A1 Jan. 11, 2007

Related U.S. Application Data

(60) Provisional application No. 60/596,073, filed on Aug. 29, 2005, provisional application No. 60/595,064, filed on Jun. 2, 2005.

(30) Foreign Application Priority Data

Aug. 29, 2005 (CA) ..... 2517494

(51) Int. Cl.
*E21B 43/26* (2006.01)

(52) U.S. Cl. ..... 166/308.1; 166/401

(58) Field of Classification Search ..... None
See application file for complete search history.

(56) References Cited

U.S. PATENT DOCUMENTS

| | | | | |
|---|---|---|---|---|
| 3,933,205 | A | | 1/1976 | Kiel |
| 3,999,607 | A | * | 12/1976 | Pennington et al. ..... 166/259 |
| 4,434,848 | A | | 3/1984 | Smith |
| 5,390,741 | A | | 2/1995 | Payton et al. |
| 5,883,053 | A | | 3/1999 | Tudor |
| 6,283,212 | B1 | | 9/2001 | Hinkel et al. |
| 6,729,409 | B1 | | 5/2004 | Gupta et al. |

FOREIGN PATENT DOCUMENTS

CA 2471559 12/2004

OTHER PUBLICATIONS

Cleat Characterisation, Imperial College London.

(Continued)

*Primary Examiner*—Zakiya W. Bates
(74) *Attorney, Agent, or Firm*—Bennett Jones LLP

(57) ABSTRACT

A well may intersect a mineral bearing stratum. A fracturing fluid in the nature of a non-participating gas may be injected into the stratum at high rates of flow, to yield a high down hole pressure, and a time v. pressure pulse extending over a period of time. A second pulse may follow the first pulse in relatively quick succession. There may be pauses, or period of relative relaxation between the pulses.

39 Claims, 4 Drawing Sheets

OTHER PUBLICATIONS

John D. Campbell, Major Cleat Trends in Alberta Plains Coals, Feb. 1979, p. 69, 70, CIM Bulletin, Feb. 1979, Edmonton, Alberta, Canada.

Othar M. Kiel, The Kiel Process—Reservoir Stimulation by Dendritic Fracturing, pp. 1-29, Houston, Texas, USA.

H.H. Abass, M.L. Van Domelen and W.M. El Rabaa, Experimental Observations of Hydraulic Fracture Propagation, Society of Petroleum Engineers, Inc. Nov. 1990, p. 239-251, Ohio US.

R.G. Jeffrey et al, Stimulation for Methane-Gas Recovery From Coal, Aug. 1998, pp. 200-207, Wyoming, USA.

M.J. Mayerhofer et al, Proppants? We don't Need No Proppants, 1997, pp. 457-464, Society of Petroleum Engineers, Texas, USA.

J.C. Gottschling et al, Nitrogen Gas and Sand: A New Technique for Stimulation of Devonian Shale, May 1985, p. 901-907, Journal of Petroleum Technolog.

H.H. Abass, S. Hedayati, C.M. Kim, Experimental Simulation of Hydraulic Fracturing in Shallow Coal Seams, SPE Eastern Regional Meeting, Oct. 22-25, 1991, Oklahoma USA.

* cited by examiner

PROCESS FOR FRACTURING A SUBTERRANEAN FORMATION

FIELD OF THE INVENTION

This application pertains to the field of treating geological formations in order to effect the recovery of flow from wells.

BACKGROUND OF THE INVENTION

A mineral bearing geological formation may include many different layers from which commercially valuable products may be obtained. In some instances, it may be desirable to recover gases from a substantially porous layered medium. That layered medium may or may not have been a zone from which commercial recovery of a product was originally foreseen at the time of original exploitation of that geological formation. However, the overall commercial recovery from well drilling and production operations may include an opportunity to obtain value by enhancing recovery from other layers of the formation.

In some instances, that opportunity may relate to the recovery of a commercially valuable fluid, such as a hydrocarbon gas. The gas may initially be stored by sorption on the large surface area of the grains of a porous substrate, such as, for example, coal grains. Commercial extraction may commence if the reservoir pressure is lower than the desorption pressure. Secondary porosity in the porous matrix may tend to provide a flow pathway for production. For example, in the context of coal, the secondary porosity features may be referred to as cleats or macropores which represents the macroporosity of the coal. It may be advantageous to encourage or stimulate gas production from such a porous matrix by, for example, increasing the size, number or network density connectivity/intersections of the cleats and macropores.

SUMMARY OF THE INVENTION

In an aspect of the invention, there is a process for treating a geological formation. The process includes the step of selecting a well bore having a producing zone including at least one coal seam at a depth of less than 2000 feet in the well bore. A supply of fracturing fluid is introduced into the well bore, the fracturing fluid being non-participating gas and being substantially free of liquid water. The non-participating gas is urged into the coal seam in a cyclical process. The flow of the non-participating gas into the well bore continues until a first threshold is reached. The flow is then relaxed until a second threshold is reached. The flow is resumed again to urge the fracturing fluid into the coal seam until a third threshold is reached. This is followed by again relaxing the flow of fracturing fluid into the coal seam.

After the above noted process, the wellbore treatment process may be continued for example with further cycles of urging the fracturing fluid into the coal seam followed by relaxing or other process steps or the process may be stopped.

In another feature of that aspect of the invention, each of the first to third thresholds may be defined by at least one criterion selected from a set of criteria consisting of: (a) a time period threshold; (b) a non-participating gas flow rate threshold; (c) a well bore surface or bottom hole pressure threshold; (d) a well bore surface or bottom hole rate of pressure change threshold (e) a gas quantity threshold and (f) a formation condition threshold.

In another feature, the process includes more than two steps of urging fracturing fluid into the coal seam, and more than two of the relaxing steps. In still another feature, one of the thresholds may be a lateral fracture threshold. In yet another feature, one of the thresholds may be a dendritic fracture threshold. In a further feature, at least one of the steps of relaxing may include extracting a portion of the fracturing fluid from the well bore. In a still further feature, at least one of the steps of relaxing may include a step of stopping flow of fracturing fluid into the well bore. In another further feature, the step of relaxing may include permitting the fracturing fluid to propagate into a fracture region in the coal seam adjacent to the well bore.

In other possible features, it is to be understood that the well bore selected in the step of selecting a well bore may have been treated in various ways, may have been drilled for various purposes and may be in various conditions. For example, the well bore may be new, may have reached maturity, may be in decline, or may have ceased to produce. Any of various fluids of interest including substantially liquids such as oil, water and/or brine, gases, mixtures and/or any of mud, sand, or other solid impurities may have or may not have been produced therethrough. The well bore may be completed, lined or open hole and may be deviated, vertical, directional, slanted or horizontal. The bore may have been drilled for the intention of producing therethrough or as a subsequent well bore into that formation for production or formation treatment therethrough. In particular, it will be appreciated that the well bore selected may be in any one or more of various conditions and may have been drilled for any one or more of a number of reasons. In another feature, the step of selecting includes the step of forming a new well bore adjacent to an existing well bore, and of obstructing access to the coal seam from the existing well bore.

In a further feature, the non-participating gas may be predominantly nitrogen. In another feature, the non-participating gas may be substantially entirely nitrogen. In still another feature, the fracturing fluid may be substantially free of proppant.

In yet another feature, the last step of relaxing may be followed by a step of recovering the fracture fluid.

In a still further feature, the process includes the step of repeating the process on a second coal seam through which the well bore passes. In yet another feature, the process includes the step of isolating the second coal seam from the first coal seam and then repeating the previous steps on the second coal seam.

As another example, the first threshold may be selected from the at least one of (a) a time period of at least 30 seconds, for example in the range of 30 seconds to 20 minutes, (b) a flow rate of dilation fluid of at least 300 standard cubic meters/minute (abbreviated as scm or $sm^3$/min), and (c) a combination of a time period of at least 30 seconds (for example 30 seconds to 20 minutes) and a flow rate of dilation fluid of at least 300 scm. In one embodiment, the first threshold may be defined as an introduction of fluid for a time period in the range of 1 to 10 minutes and a flow rate of dilation fluid of at least 1000 scm. Generally, a flow rate above 3,000 scm may be difficult to achieve.

In another feature, the first threshold may be defined, at least in part, by an introduction of dilation fluid for a period of 30 seconds to 20 minutes at a flow rate of at least 300 scm, the second threshold may be defined as a time period of more than 1 minute and less than 24 hours of a flow rate of dilation fluid of less than 300 scm, which may include 0 scm, and the third threshold may be defined as an introduction of dilation fluid for a period of 30 seconds to 20 minutes at a flow rate of at least 300 scm.

The process may also be carried out by reference to surface or bottom hole pressures, in addition to or alternately from observation of the flow rate and time. For example, the threshold for ending pressurization or pressure relaxation step of a pressure pulse may occur after a particular pressure may be maintained for a particular time or when the pressure change per unit time may be reduced below a particular level. In one possible feature of the invention, the first threshold may be selected from (a) a peak surface pressure of at least 2000 p.s.i. or at least 3500 p.s.i., (b) a peak bottom hole pressure, measured in the well bore of at least 500 p.s.i. and (c) a combination of a time period in the range of 30 seconds to 20 minutes and a peak pressure as in (a) and/or (b) immediately noted above. In one embodiment, the first threshold may be selected from (a) a peak surface pressure of at least 4500 p.s.i. or possibly at least 5000 p.s.i., (b) a peak bottom hole pressure, measured in the well bore of at least 1000 p.s.i or possibly at least 1500 p.s.i. and (c) a combination of a time period in the range of 1 to 10 minutes and a peak pressure as in (a) and/or (b) immediately noted above. Bottom hole pressure may be considered to be representative of the formation response. The bottom hole pressure and surface treating pressures of the wavetrain may be different due to friction pressure, etc. created from injection of the non-participating gas. Thus, the pressure as measured at surface during gas introduction may be more than that pressure measured downhole. Well bore pressures may be affected by a number of criteria, some of which are beyond the control of the operator, and, therefore, the pressure during any threshold may fluctuate.

In another feature, the first threshold may be defined, at least in part, by a peak pressure, and the second threshold may be defined, at least in part, as a proportion of that peak pressure. In a further feature, at the first threshold there may be a peak pressure in the well bore of $P_1$, and the second threshold may be defined, at least in part, as a proportion, $P_2$, of that peak pressure, $P_1$, and the fraction $P_2/P_1$ lies in the range of $e^{-3}$ and $e^{-1}$. In still another feature, the first threshold may be defined, at least in part, by a time interval $t_1$, and the second threshold may be defined, at least in part, by a second time interval, $t_2$.

In another feature, the second threshold may be defined, at least in part, by a decline from a peak pressure over a time period. In yet another feature, the process may have a time v. pressure characteristic having a sawtooth form, wherein the sawtooth form has a first sawtooth having an increasing pressure up to the first threshold, and a decreasing pressure to the second threshold. A second sawtooth having an increasing pressure to the third threshold, followed by decreasing pressure. Each of the increases and decreases in pressure may be associated with a respective time interval, and the first and second saw teeth may be unequal. In an additional feature, each increasing pressure time interval of each of the sawteeth may be shorter than the corresponding decreasing pressure time interval of each of the sawteeth.

In another aspect of the invention there may be a process of dilating fractures in a coal seam adjacent to a well bore, that process including the steps of pressurizing and pressure relaxation of the coal seam a plurality of times, wherein at least one of the steps of pressurizing includes introducing a fracture dilation fluid into the coal seam, the fracture dilation fluid being substantially entirely non-participating gas, and at least one of the steps of pressurizing including the step of imposing a peak pressure, as measured in the well bore downhole, of greater than 500 p.s.i.

In another feature of that aspect of the invention, at least one of the pressurizing steps includes raising the pressure in the bottom of the well bore to more than 1000 p.s.i. in a time period of less than 100 seconds. In another feature, at least one of the pressurizing steps includes a peak pressure downhole of over 1500 p.s.i. In a further feature, the peak pressure (at surface or bottom hole) in at least one of the steps may be more than double the overburden pressure at the coal seam.

These and other aspects and features of the invention are described in the description that follows.

DETAILED DESCRIPTION

Figure 1:
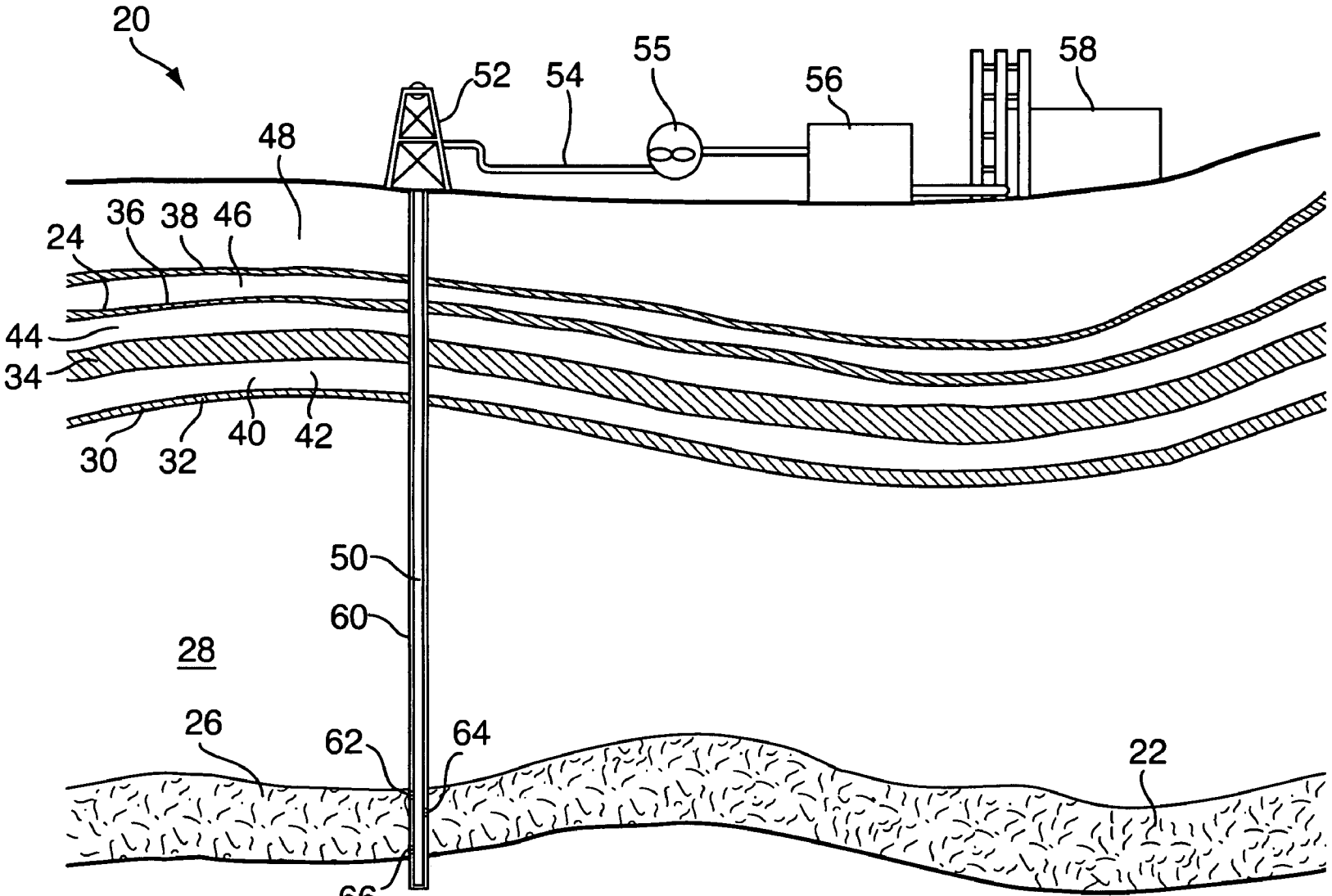
FIG. 1 is a cross section of a geological formation from which it may be desired to recover a commercially valuable product through a well production process.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, like parts are marked throughout the specification and the drawings with the same respective reference numerals. The drawings are not necessarily to scale and in some instances proportions may have been exaggerated in order more clearly to depict certain features.

In terms of general orientation and directional nomenclature, two types of frames of reference may be employed. First, although a well may not necessarily be drilled vertically, terminology may be employed assuming a cylindrical polar co-ordinate system in which the vertical, or z-axis, may be taken as running along the bore of the well, and the radial axis may be taken as having the centerline of the bore as the origin, that bore being taken as being, at least locally, the center of a cylinder whose length is many times its width, with all radial distances being measured away from that origin. The circumferential direction may be taken as being mutually perpendicular to the local axial and radial directions. The second type of terminology uses the well head as a point of reference. In this frame of reference, "upstream" may generally refer to a point that is further away from the outlet of the well, and "downstream" may refer to a location or direction that is closer to, or toward, the outlet of the well. In this terminology, "up" and "down" may not necessarily be vertical, given that slanted and horizontal drilling may occur, but may be used as if the well bore had been drilled vertically, with the well head being above the bottom of the well, whether it is or not. In this terminology, it is understood that production fluids flow up the well bore to the well head at the surface.

The present process may be conducted on various geological formations and through various access points, such as wellbores in various conditions. Various equipment may be used to conduct the wellbore treatments as will be appreciated.

Considering FIG. 1, by way of a broad, general overview and only for the purposes of illustration, a geological formation is indicated generally as 20. Geological formation 20 may include a first mineral producing region 22, and a second region 24 (and possibly other regions above or below regions 22 and 24). Region 22 may be below region 24, possibly significantly below. For example, region 22 may generally lie perhaps 1000-7000 m below the surface, whereas region 24 may tend to lie rather less than 1000 m from the surface, more typically in the in the range of about 100-700 m, or, more narrowly, 200-500 m below the surface.

Region 22 may include one or more pockets or strata that may contain a fluid that is trapped in a layer 26 by an overlying layer 28 that may be termed a cap. The cap layer 28 may be substantially impervious to penetration by the fluid. In some instances the fluid in layer 26 may be a mixture having a significantly, or predominantly, hydrocarbon based component, and may include impurities whether brine, mud, sand, sulphur or other material which may be found in various types of crude oil. It may also include hydrocarbon gases, such as natural gas, and various impurities as may be. The fluid may be under low, modest, or quite high pressure. The vertical through thickness of the potential or actual production zone of region 22 may be of the order of several hundred feet, or perhaps even a few thousand feet. The overburden pressures in this zone may be quite substantial, possibly well in excess of 1000 psi.

Region 24 may include one or more mineral bearing seams, indicated generally as 30, and individually in ascending order as 32, 34, 36, and 38. It may be understood that FIG. 1 is intended to be generic in this regard, such that there may only be one such seam, or there may be many such seams, be it a dozen or more. Seams 32, 34, 36, and 38 are separated by interlayers indicated generally as 40, and individually in ascending order as 42, 44, 46, and an overburden layer 48 (each of which may in reality be a multitude of various layers), the interlayers and the overburden layer being relatively sharply distinct from the mineral bearing seams 30, and relatively impervious to the passage of fluids such as those that may be of interest in seams 32, 34, 36 and 38. It may be noted that seams 30 may be of varying thickness, from a few inches thick to several tens of feet thick. Seams 30 may, for example, be coal seams. One or more of those mineral bearing seams may be porous, to a greater or lesser extent such that, in addition to the solid mineral, (which may be coal, for example), one or more of those seams may also be a fluid bearing stratum (or strata, as may be), the fluid being trapped, or preferentially contained in, that layer by the adjacent substantially non-porous interlayers. The entrapped fluid may be a gas. Such gas may be a hydrocarbon based gas, such as methane. The entrapped fluid may be under modest pressure, or may be under relatively little pressure. Whereas the mineral bearing zone of region 22 may be modelled as somewhat elastic, given the vertical constraint of cap 28, the significant overburden pressure, and the relatively great through thickness depth of cap 28, mineral bearing region 24 may tend to be modelled differently, given the relative thinness of the seams, and the relative lack of vertical constraint.

At some point in time a well bore 50 may have been drilled from the surface to the underlying mineral bearing stratum, or strata, 26 of region 22, and a producing well, with appropriate well head equipment 52 and a connection to a pipeline 54, whether including a compressor 55 or other feeder to a downstream storage facility 56 or processing facility 58 may have been established. During this process well bore 50 may have been lined with concrete 60 and perforated at zones 62, 64 and 66 to permit extraction of the fluid, be it substantially liquid whether crude oil alone, oil and water, in which the water may be a brine; gas alone; gas and oil or water, or both; or a slurry mixture which may include all three and a proportion of mud, sand, or other solid impurities. This well may have been a producing well for some time. The production well at bore 50 may have reached maturity and may be in decline, or may have ceased to produce.

During development of well bore 50, the upper geological formation 24 may have been identified as a mineral bearing region, and the presence of the fluids of that region may also have been identified. At the time of original development of well bore 50, economic exploitation of the upper region may have been foregone for a number of reasons. For example, seams 30 may have been too thin, or may have lain too deep, for reasonable commercial exploitation, particularly in the context of mechanical extraction by excavation. Or, alternatively, the presence of the entrapped fluid, be it methane, may itself have been a discouragement to mechanical extraction of the solid mineral by traditional mining methods. Alternatively, extraction of a commercially valuable fluid, such as methane gas, may have been impeded or discouraged by the extent to which preliminary de-watering of the upper seam may have been necessary. Extraction of the trapped fluid itself may not have been undertaken in view of the easier and perhaps more commercially attractive extraction of the liquid or gaseous fluid of region 22, or perhaps the quantities or rate of flow of the fluids in layer 24 may have been insufficient to attract interest.

Figure 2:
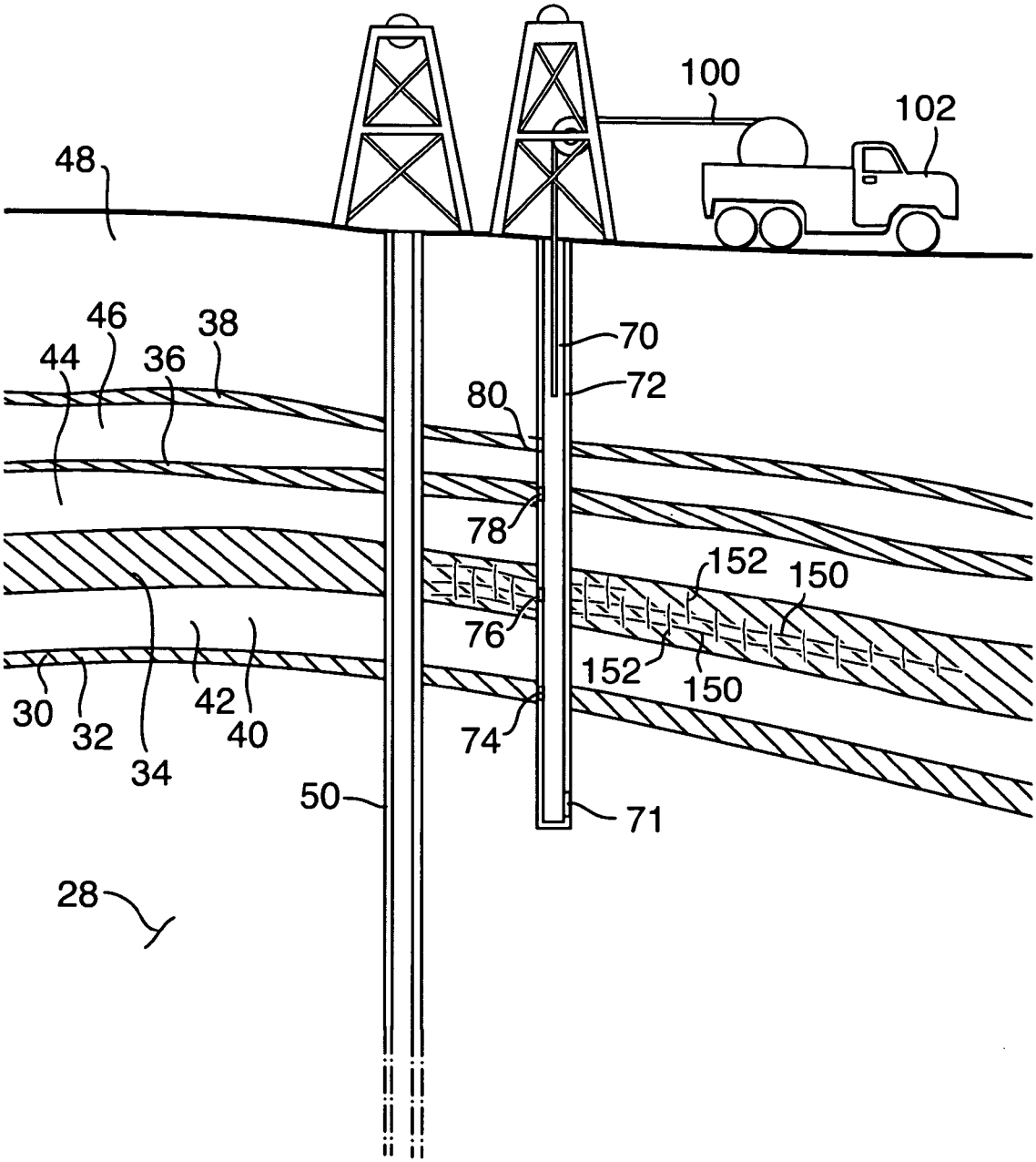
FIG. 2 is an enlarged detail of a portion of FIG. 1 at a first stage in production in which a second well has been located next to the original well.

Referring to FIG. 2, a second well bore 70 may be drilled relatively close to well bore 50. Well bore 70 may have a depth only as deep as, or, allowing for a rat hole 71, marginally deeper than upper region 24. Well bore 70 may be lined as indicated at 72, and that lining may be perforated at 74, 76, 78 and 80 to permit fluid to flow from the strata of region 24 into well 70. The flow of interest may be a gas flow, such as a flow of methane.

The well bore, for example, may be accessed in some way, as for example with a coiled tubing unit and bottom hole packer assembly to selectively isolate and individually stimulate each seam such as 32, 34, 36 or 38. Other methods such as bridge plugs and tubing deployed by a combination of service rig and or snubbing unit and wireline can also be used to mechanically isolate the coal seams or lenticular formations.

Initially, prior to the procedure described herein, the flow of gas, from bore 70 may not be as great as it might be. Where flow from a deep oil well is poor, an operator may wish to attempt to make the fissures and fractures open and propagate away from the well. In deep oil wells, it is also known to prop the fractures open, typically using a proppant such as frac sand. One such method is to pump an aqueous, proppant laden foam or emulsion, into an oil well such that the frac sand may be introduced into the fine fissures under pressure. The pressure may cause the fissures to open somewhat, and then, when the pressure is relieved, at least a portion of the proppant, i.e., the frac sand, may tend to stay in place, preventing the fractures from closing. This may then leave larger pathways in the geological formation through which oil may flow to the well bore, permitting those desired fluids (and other impurities) to be pumped up to the well head. As noted, proppant may usually be carried into place by a medium such as an aqueous foaming agent, and may typically be used in an oil or oil and gas extraction process in deep wells (i.e., deeper than about 1000 m). Once the extraction zone has been treated in this way, the carrier liquid is pumped out of the well, and a production fluid, which may be a mixture of oil, gas, brine, mud, sand and other impurities, may be produced from the well.

In the natural state, each of seams 32, 34, 36 or 38 may exhibit natural "cleating", which is to say cracks and fractures in the seam that give it a measure of porosity, which may be termed secondary porosity or macroporosity, such as may tend to provide a pathway to permit the fluid to migrate in the seam to the well bore. The degree of prevalence of "cleating" may tend to determine the rate at which the fluid may flow out of the seam. The rate at which the fluid may be extracted may range from a very slow seepage to a more lively flow. Where the flow is not satisfactory, as when, for example, it is insufficient to sustain a commercial gas production rate, it may be desirable to enhance the flowrate by encouraging a greater amount of cleating, such as to improve the overall porosity, cleat connectivity/intersections, and permeability of the mineral bearing stratum adjacent to well bore 70, or by encouraging "spalling" on the faces of the existing cleats, spalling being a breaking off of the surface material of the fracture face. For example, a coal seam may tend to have lower permeability than some other materials, and may require a form of stimulation to achieve commercial CBM gas production. In such an instance, fracture stimulating the porous matrix may tend to increase the degree of cleating in the matrix, may tend to increase the effective drainage region of the seam, and may tend to enhance interconnection/connectivity of the cleat network to the well bore. Further, it may tend to permit the flow to by-pass damage in the matrix near the well bore. It may be advantageous to employ a cyclic or pulse fracturing stimulation technique, as described herein, to enhance (a) extension of the coal cleat drainage region; and (b) the interconnection of coal cleats within that region. That is, cyclic or pulse fracturing as described herein may tend to increase fracture network length by a process referred to as dendritic branching. It may tend to enhance fracture network conductivity by promoting shear slippage and spalling of the fines, e.g. coal fines, which may then tend to hold cracks and fissures in the matrix open to allow more flow to the well bore.

There are a number of factors to be considered. First, some production regions, of which region 24 may be one, may include clays or other materials that may tend to swell in the presence of water. Aqueous liquids, or aqueous liquid based flows, may tend to be common frac fluids. If the matrix of the production zone swells, the cleating may tend to close up, and the well may tend to produce less oil or gas, or oil and gas, than may have been expected, or desired. Alternatively, the frac fluid, or slurry, may not be chemically inert, and may interact with the cleating surfaces in such as way as to close up the fractures, and to impede flow, rather than to facilitate flow. Second, in some wells, the frac sand, or perhaps drilling mud employed in the boring and completion of the well, may itself tend to block the porous structure adjacent to the well, thereby impeding flow of the desired fluid. Third, depending on the completion process employed, it may be necessary to remove the proppant carrier fluid, and perhaps sand or other solids, perhaps including drilling mud. This may be followed by a swabbing procedure to try to remove leftover mud, for example.

Fourth, the process of introducing a fluid under pressure to "frac" the well, i.e., to open up, or dilate, the adjacent porous structure along its fracture surfaces, may tend to occur in a radiating manner from the well bore, and may sometimes tend only to have modest long term effects in increasing the flow of oil and gas wells. It may be desirable to enhance the formation and enlargement of dendritic crack formations in the adjacent geological structures. That is, the cleating in a formation may tend to run generally in one direction, and the main fractures providing the porosity permitting the fluid to be extracted may tend to run in that one direction. It may be that the rate of hydrocarbon production may improve where fractures are enhanced generally perpendicular to the predominant fracture direction in the region, and the crossing-linking, or branches of a dendritic crack formation, tending to extend away, possibly perpendicularly away, from the primary fissures, may tend to link parallel fractures, and may tend to enhance the flow running through those links, and ultimately to the well bore.

To that end, fluid injection equipment, symbolised by service truck 102, may be employed to introduce fluid under pressure into bore 70, and, by positioning the end of the Coiled tubing bottom hole assembly appropriately, into each one of seams 32, 34, 36 and 38. That is to say, the lower end 112 of coiled tubing 114 can be located between the coiled tubing bottom hole assembly, isolation represented by elements 82 and 84, and those elements of the BHA can be sealed using the coiled tubing unit, such that fluid introduced under pressure may tend to be forced into seam 32 only. In one method, the coiled tubing bottom hole assembly BHA may be set above seam 32, 34, 36 and 38 to permit fluid to be forced into all of the seams at once. However, it may be taken that in one method, first one seam than another may be subjected to the introduction of fluid under pressure. Further, that method may include the step of pressurizing the seams sequentially from the lowest (i.e., farthest from the wellhead) to the highest (i.e., nearest to the wellhead), moving one by one. It may be appreciated that some of the seams may be too thin to yield economic recovery.

A fracture dilation fluid may be introduced under pressure to force the natural cleats in the mineral bearing stratum to dilate, and to spall, (that is, to crack further, to cause portions of the stratum to separate. A gas under high pressure may be the fluid used in the dilation process. A gas may have less tendency than a liquid to cause the material of the stratum to swell. One step may be to select a gas that is relatively inert in terms of chemical (as opposed to mechanical) interaction with the material of the stratum. Such a gas that has little or no tendency to react with the stratum to be dilated may be termed non-participating, or non-reactive. For example, in a carboniferous environment, such as a coal seam, nitrogen gas may be introduced. Although other gases, such as inert, or relatively inert, gases may be used, nitrogen may tend to be readily available and comparatively inexpensive to obtain in large quantities. The gas need not be entirely of one element, but may be a mixture of non-reactive gases. Making allowance for trace elements, the frac fluid chosen may be substantially free of reactive gases or liquids, and may be substantially, or entirely, free of liquids, including being free of aqueous liquids such as water or brine.

In one step, the gas introduced under pressure may be forced into the designated layer at a pressure that is greater than five times as great as the pre-existing static pressure in the well bore at the selected stratum. For example, where the natural pressure in the well bore may be in the range of 100-150 psia, (0.7-1.0 MPa) the pressure of the introduced gas may be more than 5 times as great, and may be as great as 30 to 60 times as great or greater. The surface pressure of the introduced gas may be greater than 2000 psi, or possibly greater than 5000 psia and in one embodiment may be about 5000-8000 psia. Expressed alternatively, the peak pressure may be more than double, and perhaps in the range of 3 to 10 times as great as the overburden pressure at the location of the stratum, or seam, to be dilated. Not only may the frac fluid be introduced at a surface pressure of greater than 2000 psi, or, indeed greater than 3000 psi, but, in addition, the frac gas may be introduced at a high rate, such that the rate of pressure rise in the surrounding stratum or seam of interest may be rapid. This rate of pressure rise may be measured in the well bore as a proxy for the rise in the surrounding formation, or fracture zone. For example, the rate of flow may be as great or greater, than required to achieve a pressure rise of 500 psi bottom hole pressure in the well bore over an elapsed time of 100 second or less, and may be such as to raise the pressure 500 psi in the range of 50 to 75 seconds. The apparatus located in the well bore may include a pressure sensor such as may be used to observe the pressure in the well bore, and a suitable feedback apparatus by which the pressure may be monitored from the surface, and the fluid introduction equipment may be operated to introduce additional gas, as may be.

It may be that this comparatively large pressure rise, occurring at a relatively high rate, may tend to result in brisk crack dilation, or crack propagation, notwithstanding the comparative lack of vertical restraint on the seam or stratum of interest given the comparatively low overburden pressure of, for example, layer 48.

The pressure surges may be alternately defined by reference to flow rate. For example, starting from the initial well bore pressure the fracture dilation gas may be introduced in a first surge at a flow rate of at least 300 scm or possibly at least 1000 scm over a time period of 1 to 20 minutes or possibly 1 to 10 minutes, such that the pressure in the stratum, as measured in the well bore, is raised to an elevated level. Following this rise, a period of relaxation may occur in which the inflow of frac gas may be stopped or may be greatly diminished to a rate of less than 300 scm, and during which the pressure in the well bore downhole may tend to decline over a time period of less than 24 hours or possibly less than 12 hours and in one embodiment less than one hour to some lesser value. At the end of that time period, the fracture dilation gas under pressure may again be introduced (or reintroduced, as may be) as a surge at a flow rate of at least 300 scm or possibly at least 1000 scm over a time period of 1 to 20 minutes or possibly 1 to 10 minutes such that the pressure in the well bore is raised.

The introduction of frac fluid, such as non-participating frac gas, may be a cyclic process involving a number of iterations of raising pressure in the well bore, followed by a period of relaxation of the introduction of frac fluid into the formation. The step of relaxation may include lessening the inflow of frac gas, or may include cessation of the inflow, or may include extraction of a portion of the frac gas. Typically, relaxation may involve cessation of the flow, while permitting the surge of frac gas to diffuse, or spread, into the surrounding formation, and, in so doing, to permit the pressure in the surrounding formation, and in the well bore, to decline. The cycles may be irregular. That is to say, although iterations of raising the pressure, and relaxing the pressure in the well bore, and hence in the surrounding formation, may occur in the form of a wavetrain of pulses that are identical in terms of input flowrate and duration, or peak pressure and duration such as to produce a regular wave pattern, in the more general case this need not be so, and may not be so. The amplitude of individual pulses may not be the same as any other, either in terms of maximum frac gas flowrate, or in terms of peak pressure during the pressure pulse, and the duration of the pulses may vary from one to another. Similarly, while the periods of relaxation may be of the same duration, in the general case they need not be, and may not be.

Similarly, too, the transition thresholds from one stage of a pulse to another may be defined by any of several criteria, or more than one of them. For example, the pressure rise may terminate either when a peak pressure is reached, or when there is a distinct spike, or step, or discontinuity in the pressure versus time plot, or when there is a decline of a certain amount, such as 10 percent, from the peak pressure, or when the rate of pressure change falls below a certain proportionate, or normalised value, be it 1% of the peak value per second, or it may be an explicit rate, such as 10 psi/s, or 2 psi/s, as may be. The pressure rise and relaxation curves may have an arcuate form that is similar to an exponential decay curve, and the threshold for ending the pressure rise or relaxation stage of a pressure pulse may occur after a number of time constants on that curve have been reached, be it 1, 2, 3, 4 or 5 time constants, or such as when the increase in pressure per unit time is less than 1%, or 2% as may be where one time constant $\epsilon^{-1}$ may correspond to the time interval that may elapse as the observed valve, such as downhole pressure, drops for some peak differential value to roughly 37% of that value, two time constants, $\epsilon^{-2}$ corresponds to a decay to roughly 13½% of the peak differential, three time constants $\epsilon^{-3}$ corresponds roughly 5% and so on. Alternatively, the pressure rise stage may cease after a fixed time, such as 90 seconds, or after a fixed quantity of flow (which may be measured either as a mass flow or as a normalised volumetric flow, for example). It may be that the relaxation stage of the pulse may be of longer or significantly longer duration than the pressure rise stage. For example, the relaxation stage time period may be in the range of 1 to 5 or more times as long as the pressurizing stage preceding it. The resulting pulse may have a sawtooth shape. The faces of the sawtooth may be arcuate, may be exponential decay curves, and may be unequal. As noted, each successive pulse may be of a different shape. Although a wave train, or pulse train, may have as few as two pulses, it may be that a pulse train of three or more pulses may be employed.

Figure 3:
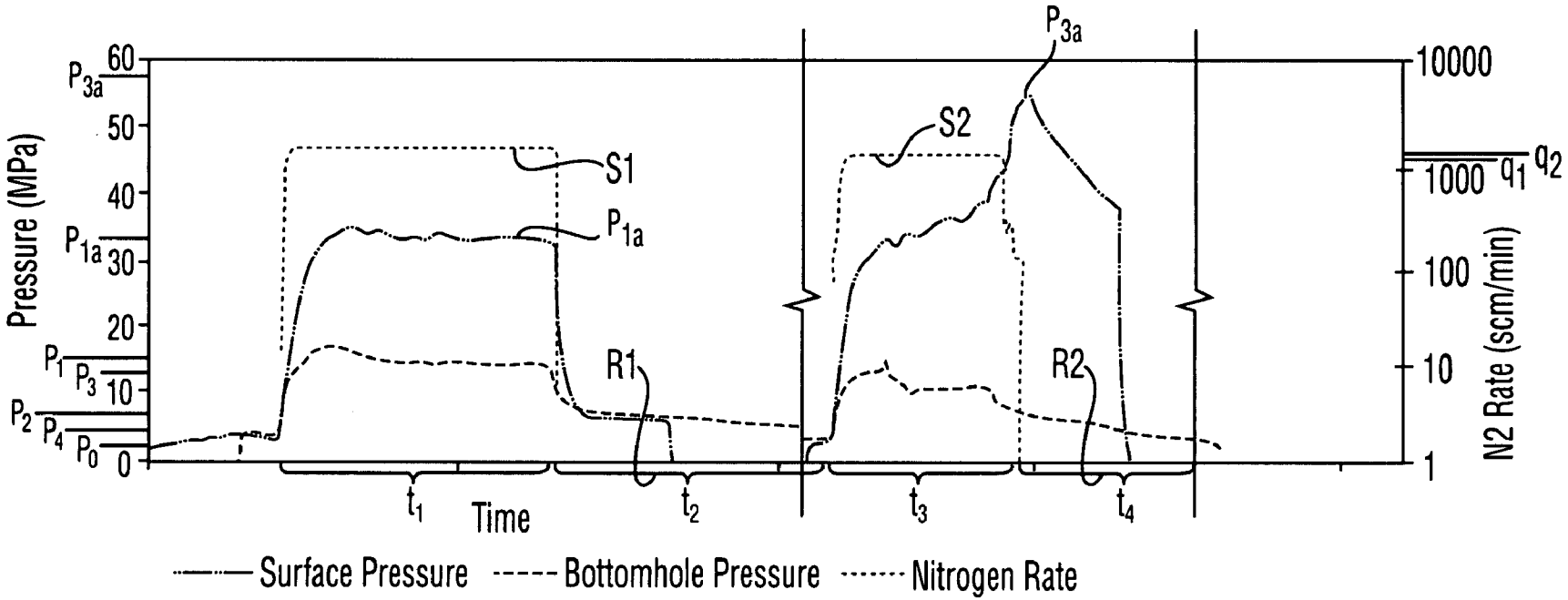
FIG. 3 shows a chart of a formation treatment process according to the present invention.

In general, then, a frac fluid in the form of a non-participating gas may be introduced into well bore 70 to pressurize the well bore more than one time. With reference to FIG. 3, for example, In one embodiment, with reference to FIG. 3, the introduction of frac fluid, such as non-participating frac gas, to the wellbore may be a cyclic process involving a number of iterations of raising pressure in the well bore adjacent the seam of interest, such as a first surge S1, a second surge S2, etc., with each surge followed by a period of relaxation of the introduction of frac fluid into the formation R1, R2. The steps of relaxation may include cessation of the inflow (as shown), may include lessening the inflow of frac gas, or may include extraction of a portion of the frac gas. Typically, relaxation may involve cessation of the flow, while permitting the surge of frac gas to diffuse, or spread, into the surrounding formation, and, in so doing, to permit the pressure in the surrounding formation, and in the well bore, to decline. The cycles may be irregular. That is to say, although iterations of raising the pressure, and relaxing the pressure in the well bore, and hence in the surrounding formation, may occur in the form of a wavetrain of pulses. Such pulses may be substantially identical in terms of input flow rate and duration, such as to produce a regular wave pattern, but in the more general case this need not be so, and may not be so. The amplitude of an individual pulse may or may not be the same as any other, either in terms of maximum frac gas flow rate, or in terms of peak pressure during the pressure pulse, and the duration of the pulses may vary from one to another. Similarly, while the periods of relaxation may be of the same duration, in the general case they need not be, and may not be.

In general, then, a frac fluid in the form of a non-participating gas may be introduced into well bore to pressurize the well bore more than one time per job (i.e. per seam 36 or formation region to be treated). That is, starting from an initial well bore pressure, $P_0$, a first surge S1 of gas may be introduced at a flow rate $q_1$, over a time period $t_1$ to raise the pressure in the stratum, as measured in the well bore, to an elevated level, $P_1$.

Following this rise, a period of relaxation R1 may occur in which the inflow of frac gas may be greatly diminished or stopped (or possibly reversed), and during which the pressure is permitted to decline over a time period, $t_2$, to some lesser value $P_2$. $P_2$ may lie at a portion of the difference between the high pressure value $P_1$, and the initial unpressurized value $P_0$, or may be roughly the initial unpressurized value $P_0$.

At the end of that time period, $t_2$, the gas under pressure may again be introduced (or reintroduced, as may be) in a second surge S2 at a flow rate $q_2$ over a time period $t_3$, to raise the pressure in the well bore to a high pressure $P_3$.

The surge S2 may be followed by another time period, $t_4$, of relaxation R2 in which the pressure may fall to a lower pressure $P_4$, which may be followed by another pressure rise over a time period to a high pressure, and another period of relaxation to a reduced pressure. Additional pulses may follow in a similar manner, each pulse having a rising pressure phase and a falling pressure phase. Alternately, the procedure may be stopped after surge S2 or any surge thereafter. This is indicated, generically, in the wavetrain illustration of FIG. 3.

It may be that this comparatively large pressure rise, occurring at a relatively high rate, may tend to result in brisk crack dilation, or crack propagation, notwithstanding the comparative lack of vertical restraint on the seam or stratum of interest given the comparatively low overburden pressure. It is further believed that a process of introducing a fluid under pressure to "frac" the well, i.e., to open up, or dilate, the adjacent porous structure along its fracture surfaces, may tend to occur in first a radiating manner forming main fractures 150 from the well bore, in for example, the first pressurizing step and then in later pressurizing steps, there may be the formation and/or enlargement of dendritic crack formations 152 in the adjacent geological structures. That is, the fractures in a formation may tend to first run generally in one direction through main cracks, which may tend to run in that one direction and then the fractures may branch laterally, termed dendritic cracks or fractures, tending to extend away, possibly perpendicularly away, from the main primary fractures, may tend to link parallel fractures, branch fractures and create more laterals. This fracture generation may tend to enhance the flow running through those the main fractures, and ultimately to the well bore. It may be that the rate of hydrocarbon production may improve where fractures are generated dendritically.

The natural pressure in the well bore may be generally about 100-150 psia (0.7-1.0 MPa). Using reference to FIG. 3, in one embodiment, starting from the initial well bore pressure, $P_0$, the gas may be introduced in the first surge S1 at a flow rate $q_1$ of at least 300 scm or possibly at least 1000 scm over a time period $t_1$ of 1 to 20 minutes or possibly 1 to 10 minutes, to raise the pressure in the stratum, as measured in the well bore, to an elevated level, $P_1$. Following this rise, the period of relaxation R1 may occur in which the inflow of frac gas may be greatly diminished or stopped to a rate of less than 300 scm, and during which the pressure is permitted to decline over a time period, $t_2$ of less than 24 hours or possibly less than 12 hours and in one embodiment less than one hour, to some lesser value $P_2$.

At the end of that time period, $t_2$, the gas under pressure may again be introduced (or reintroduced, as may be) as surge S2 at a flow rate $q_2$ of at least 300 scm or possibly at least 1000 scm over a time period $t_3$ of 1 to 20 minutes or possibly 1 to 10 minutes to raise the pressure in the well bore to a high pressure $P_3$. In the illustrated embodiment, the injection assembly became plugged, as indicated by the sharp increase in the surface pressure to a maximum peak $P_{3a}$. Thereafter the process was stopped.

The surface pressure $P_{1a}$ of the introduced gas during surge S1 may be greater than 2000 psi, or possibly greater than 5000 psia and in one embodiment may be about 5000-8000 psia. Expressed alternatively, the peak pressure may be more than double, and perhaps in the range of 3 to 10 times as great as the overburden pressure at the location of the stratum, or seam, to be dilated. Not only may the frac fluid be introduced at a surface pressure of greater than 2000 psi, or, indeed greater than 3000 psi, but, in addition, the frac gas may be introduced at a high rate, such that the rate of pressure rise in the surrounding stratum or seam of interest may be rapid. This rate of pressure rise may be measured in the well bore as a proxy for the rise in the surrounding formation, or fracture zone. For example, the rate of flow may be as great or greater, than required to achieve a pressure rise of 500 psi bottom hole pressure in the well bore over an elapsed time of 100 second or less, and may be such as to raise the pressure 500 psi in the range of 50 to 75 seconds.

Figure 3A:
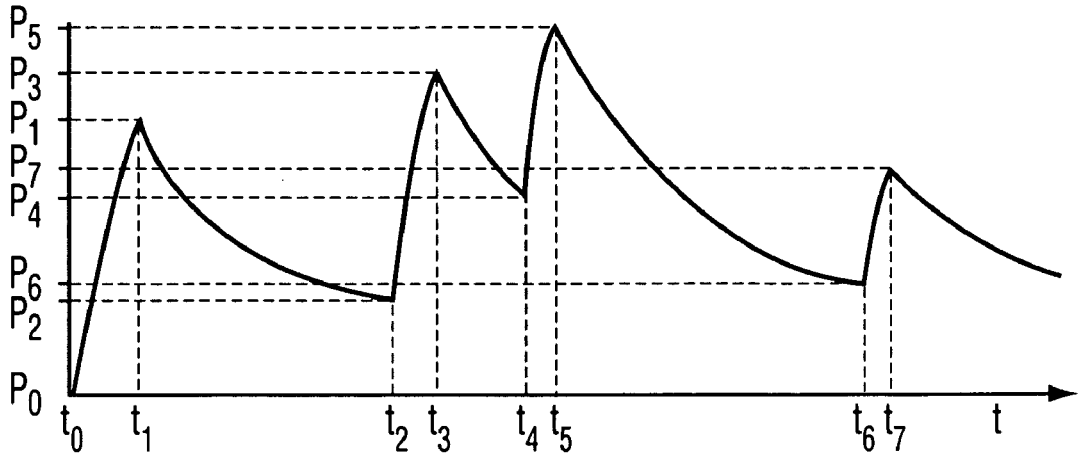
FIG. 3*a* shows a chart of pressure against time for a process of dilation which may be used in the geological formation of FIG. 2.

With reference to FIG. 3*a*, another process is shown wherein starting from an initial well bore pressure, $P_0$, the gas may be introduced at a flowrate $q_1$ over a time period $t_1$ to raise the pressure in the stratum, as measured in the well bore, to an elevated level, $P_1$. Following this rise, a period of relaxation may occur in which the inflow of frac gas may be greatly diminished or stopped (or possibly reversed), and during which the pressure may be permitted to decline over a time period to a time, $t_2$, to some lesser value $P_2$. $P_2$ may lie at a portion of the difference between the high pressure value $P_1$ and the initial unpressurized value $P_0$, or may be roughly the initial unpressurized value.

At the end of that time period, at time $t_2$, the gas under pressure may again be introduced (or re-introduced, as may be) at a flowrate $q_2$ over a time period until time $t_3$, to raise the pressure in the well bore to a high pressure $P_3$. This may be followed by another time period, ending at time $t_4$, of relaxation in which the pressure may fall to a lower pressure $P_4$, which may be followed by another pressure rise over a time period $t_5$, to a high pressure $P_5$, and another period of relaxation, $t_6$ to a reduced pressure $P_6$. Additional pulses may follow in similar manner, each pulse having a rising pressure phase and a falling pressure phase. This is indicated, generically, in the wavetrain illustration of FIG. 3*a*.

Figure 3B:
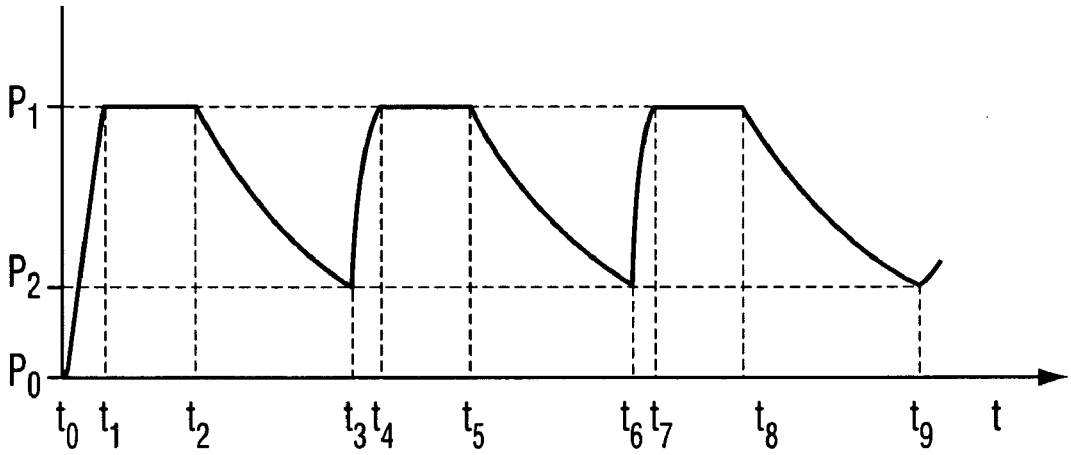
FIG. 3*b* shows a chart of pressure against time for an alternate process of dilation to that of FIG. 3*a*.

While FIG. 3*a* is intended to represent the generic case, FIG. 3*b* shows a series of repeated cycles, which may be governed by a peak pressure $P_1$, and a relaxation pressure $P_2$, with the cycles working between $P_1$ and $P_2$ after an initial commencement at $P_0$. This process may also include a dwell time at the peak pressure (or, in a peak pressure range, which may be considered to be, roughly, a constant pressure), over the time intervals between $t_1$ and $t_2$, $t_4$ and $t_5$, and $t_7$ and $t_8$, as may be. There may then be a pressure drop back to $P_2$, as in the time intervals between $t_2$ and $t_3$, $t_5$ and $t_6$, and $t_8$ and $t_9$. Alternatively, there may not be a dwell time, but rather merely a decline from the peak pressure to the low threshold, $P_2$. Where a dwell time is employed, that interval may be constant from cycle to cycle. Where a pressure decline occurs, rather than governing on the value of the pressure, as at $P_2$, the cycle may be governed by a constant elapsed relaxation time, or decline time, which may correspond to a time interval such as either $t_1$ to $t_3$, or $t_2$ to $t_3$. Given that it may be difficult to maintain a precise pressure in a leaking stratum, the peak pressure and low pressure values may be thought of as ranges in which the pressure is generally roughly constant over a period of time, where the pressure fluctuation is within perhaps 5% or 10% of a target value.

Figure 3C:
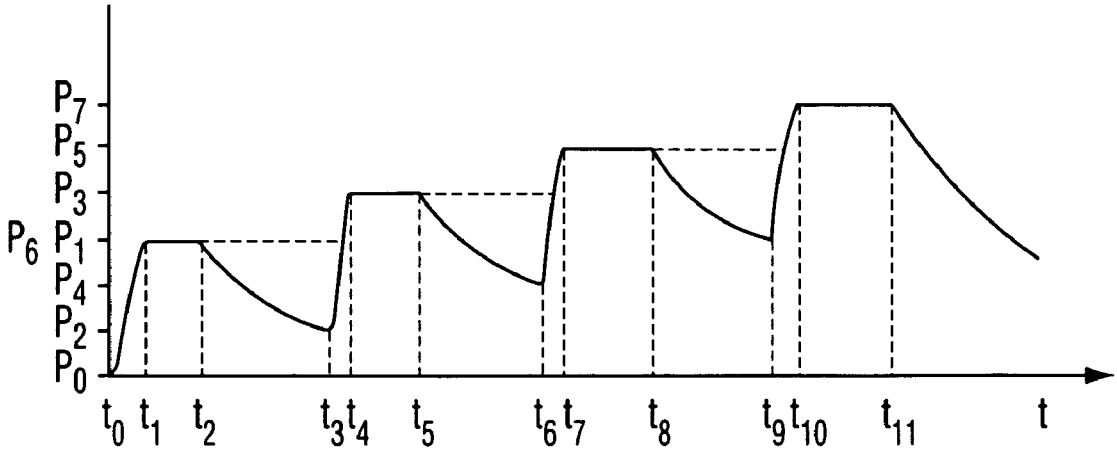
FIG. 3*c* shows a chart of pressure against time for a further alternate process of dilation to that of FIG. 3*a*.

In the alternative of FIG. 3*c*, it may be that the cyclic pressurization of the surrounding stratum occurs in a series of stepwise increasing pulses, in which $P_3$ is greater than $P_1$, $P_5$ is greater then $P_3$, $P_7$ is greater than $P_5$, and so on, as may be. The increment between $P_1$ and $P_3$, $P_3$ and $P_5$, and $P_5$ and $P_7$ may be roughly constant, so that the height of the "steps" are roughly equal. It may be that the peak pressure at each of the successive steps is held constant by maintaining a large gas inflow rate, until it is time to bump the pressure up again to the next step. This is signified by the dashed lines that run at constant pressure. Alternatively, there may be a period of time at the peak pressure, or peak pressure range, followed by a decline, as represented by the dwell plateau between, for example, $t_1$ and $t_2$, $t_4$ and $t_5$, $t_7$ and $t_8$, and $t_{10}$ and $t_{11}$. This dwell time may be followed by a decline in pressure, as from $t_2$ to $t_3$, $t_5$ to $t_6$, $t_8$ to $t_9$ and so on.

In some instances, when a stratum of interest is to receive a frac treatment as described above, it may be necessary as a preliminary step to de-water the well bore, to one degree or another. That is, some seams may be above the level requiring de-watering, while others may not be, or all may be dry, or all may require de-watering. Also, in some instances some or all of the layers of interest may require a chemical treatment to activate the layer. Activation may involve the injection and subsequent draining of an activating agent such as may be an acidic activating agent, of which one example might be hydrochloric acid in solution.

In another embodiment, the step of fracturing may be preceded by the step of cementing the lower portion of a fully depleted production well, or one whose lower, or former, producing zone is to be abandoned, or left dormant. For example, it need not be that a new bore, such as well bore 70 be drilled, but rather an existing bore, such as bore 50 may be plugged and cemented at some location below stratum 32, appropriate plugs and valves installed thereabove, and suitable perforation steps performed. For example, that process may include the step of re-cementing a perforated portion of an existing well, or of perforating a new portion of an adjacent well or of perforating a new portion of the existing well in the new stratum (or strata) of interest. That is, bore 50 could be perforated at layers 32, 34, 36 and 38 in a manner analogous to that described above in the context of items 74, 76, 78 and 80.

In an alternate embodiment, the gas fracturing fluid may be used to transport a proppant into the fracture network of the surrounding geological matrix. When used to transport a proppant, such as frac sand, the gas pressure may be greater than the vapour dome critical pressure of that gas.

In another alternate embodiment, the fracturing process may be repeated after a period of production has occurred.

In another embodiment, the process may include the step, or steps, of performing cyclic or pulsed fracturing in a non-mineral bearing region. For example, a geological formation of interest may include a portion that is mineral bearing and a portion that is non-mineral bearing, such as a sand or sandstone region. The mineral bearing and non-mineral bearing regions may be intermixed, or indistinct. However, gas desorption in the mineral bearing region may be enhanced by fracturing, and gas path fracture networking in the matrix, whether in the mineral bearing or non-mineral bearing region, may be enhanced such as to encourage flow of the gas through both the mineral bearing and non-mineral bearing regions. For example, a sedimentary matrix of sandstone may be fractured in a series of cycles or repetitions, as described above, to provide a path network of cleats extending to adjacent mineral bearing zones.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A process for treating a geological formation, said process comprising the steps of:

selecting a well bore having a producing zone including at least one coal seam at a depth of less than 2000 feet in the well bore;

introducing a supply of fracturing fluid into the well bore, the fracturing fluid being non-participating gas and being substantially free of liquid water;

urging the non-participating gas into the coal seam until a first threshold is reached;

relaxing the flow of fracturing fluid until a second threshold is reached;

resuming urging of the fracturing fluid into the coal seam until a third threshold is reached; and again relaxing the flow of fracturing fluid into the coal seam.

2. The process of claim 1 wherein:

said first threshold is defined by at least one criterion selected from a first set of criteria consisting of (a) a time period threshold;

(b) a non-participating gas quantity threshold;

(c) a well bore pressure threshold; and (d) a well bore rate of pressure change threshold;

said second threshold is defined by at least one criterion selected from a second set of criteria consisting of:

(a) a time period threshold;

(b) a non-participating gas quantity threshold;

(c) a well bore pressure threshold; and (d) a well bore rate of pressure change threshold said third threshold is defined by at least one criterion selected from a third set of criteria consisting of:

(a) a time period threshold;

(b) a non-participating gas quantity threshold;

(c) a well bore pressure threshold; and (d) a well bore rate of pressure change threshold.

3. The process of claim 1 wherein said step of selecting a well bore includes the step of selecting a well bore that is substantially free of water at the level of said coal seam.

4. The process of claim 1 wherein the step of introducing the fracturing fluid is preceded by the step of de-watering said well bore to at least the level of said coal seam.

5. The process of claim 1 wherein said process includes more than two steps of urging fracturing fluid into the coal seam, and more than two of said relaxing steps.

6. The process of claim 1 wherein one of said thresholds is a lateral fracture threshold.

7. The process of claim 1 wherein one of said thresholds is a dendritic fracture threshold.

8. The process of claim 1 wherein at least one of said steps of relaxing includes a step of stopping flow of fracturing fluid into said well bore.

9. The process of claim 8 wherein said step of relaxing includes permitting said fracturing fluid to propagate into a fracture region in said coal seam adjacent to said well bore.

10. The process of claim 1 wherein said non-participating gas is predominantly nitrogen.

11. The process of claim 1 wherein said non-participating gas is substantially entirely nitrogen.

12. The process of claim 1 wherein said fracturing fluid is substantially free of proppant.

13. The process of claim 1 wherein said process includes the step of repeating said process on a second coal seam through which said well bore passes.

14. The process of claim 13 wherein said process includes the step of isolating said second coal seam from said first coal seam before repeating said process on said second coal seam.

15. The process of claim 1 wherein at least one of the first and thirds thresholds are defined at least in part, by an introduction of dilation fluid for a period of at least 30 seconds at a flow rate of at least 300 scm.

16. The process of claim 1 wherein the second threshold is defined at least in part as a time period of more than 1 minute and less than 24 hours of a flow rate of dilation fluid of 0 to 300 scm.

17. The process of claim 1 wherein the first threshold is defined by an introduction of dilation fluid for a period of 30 seconds to 20 minutes at a flow rate of at least 300 scm, the second threshold is defined as a time period of more than 1 minute and less than 24 hours of a flow rate of dilation fluid of 0 to 300 scm and the third threshold is defined as an introduction of dilation fluid for a period of 30 seconds to 20 minutes at a flow rate of at least 300 scm.

18. The process of claim 1 wherein at least one of the first and thirds thresholds is defined at least in part, by an introduction of dilation fluid for a time period in the range of 1 to 10 minutes and at a flow rate of dilation fluid of at least 1000 scm.

19. The process of claim 1 wherein said first threshold is defined at least in part from the set consisting of (a) a time period in the range of 30 seconds to 20 minutes; (b) a peak pressure measured at surface of greater than 2000 psi; and (c) a combination of a time period in the range of 30 seconds to 20 minutes and a peak surface pressure of greater than 2000 psi.

20. The process of claim 1 wherein said first threshold is defined at least in part from the set consisting of (a) a time period in the range of 1 to 10 minutes; (b) a peak pressure measured at surface of greater than 5000 psia; and (c) a combination of a time period in the range of 1 to 10 minutes and a peak pressure greater than 5000 psia.

21. The process of claim 1 wherein at the first threshold and at the third threshold the introduction of dilation fluid generates a peak bottom hole pressure, measured in the well bore, of at least 500 p.s.i.

22. The process of claim 1 wherein at the first threshold and at the third threshold the introduction of dilation fluid generates a peak bottom hole pressure, measured in the well bore, of at least 1000 p.s.i.

23. The process of claim 1 wherein the first threshold and the third threshold are reached by introduction of dilation fluid at a rate of flow to achieve a pressure rise of 500 psi bottom hole pressure in the well bore over an elapsed time of less than or equal to 100 seconds.

24. The process of claim 1 wherein said first threshold is defined, at least in part, by a peak pressure, and said second threshold is defined, at least in part, as a proportion of that peak pressure.

25. The process of claim 1 wherein at said first threshold there is a peak pressure in the well bore of $P_0$, and said second threshold is defined, at least in part, as a proportion, $P_1$, of that peak pressure, $P_0$, and the fraction $P_1/P_0$ lies in the range of $e^{-3}$ and $e^{-1}$.

26. The process of claim 1 wherein said first threshold is defined, at least in part, by a time interval $t_1$, and said second threshold is defined, at least in part, by a second time interval, $t_2$, and wherein the $t_2$ is longer than $t_1$.

27. The process of claim 1 wherein said second threshold is defined, at least in part, by a decline from a peak pressure over a time period.

28. The process of claim 1 wherein said process has a time v. pressure characteristic having a sawtooth form, wherein said sawtooth form has a first sawtooth having an increasing pressure up to said first threshold, and a decreasing pressure to said second threshold; and a second sawtooth having an increasing pressure to said third threshold, and wherein each of said increases and decreases in pressure is associated with a respective time interval, and said first and second saw teeth are unequal.

29. The process of claim 28 wherein each increasing pressure time interval of each of said sawteeth is shorter than the corresponding decreasing pressure time interval of each of said sawteeth.

30. A process of dilating fractures in a coal seam adjacent to a well bore, that process including the steps of pressurizing and pressure relaxation of the coal seam a plurality of times, wherein at least one of the steps of pressurizing includes introducing a fracture dilation fluid into the coal seam, the fracture dilation fluid being substantially entirely non-participating gas, and at least one of the steps of pressurizing including the step of imposing a peak pressure, as measured at surface, of greater than 2000 p.s.i.

31. The process of claim 30 wherein at least one of said pressurizing steps includes raising the pressure at surface to more than 2000 p.s.i. in a time period of less than 100 seconds.

32. The process of claim 31 wherein at least one of said pressurizing steps includes a peak surface pressure of over 3500 p.s.i.

33. The process of claim 30 wherein at least one of said pressurizing steps includes achieving a pressure increase downhole of 500 p.s.i. in a time period of less than 100 seconds.

34. The process of claim 30 wherein the peak pressure in at least one of said steps is more than double the overburden pressure at the coal seam.

35. The process of claim 30 wherein said non-participating gas is predominantly nitrogen.

36. The process of claim 30 wherein said non-participating gas is substantially entirely nitrogen.

37. The process of claim 30 wherein at least one of said pressurizing steps includes introducing dilation fluid at a flow rate of at least 300 standard cubic meters/minute.

38. The process of claim 37 wherein the dilation fluid is introduced over a time period in the range of 30 seconds to 20 minutes.

39. The process of claim 30 wherein at least one of said pressurizing steps includes introducing dilation fluid for a time period in the range of 1 to 10 minutes and at a flow rate of dilation fluid of at least 1000 scm.

* * * * *